US007192066B2

(12) United States Patent
Ilea et al.

(10) Patent No.: US 7,192,066 B2
(45) Date of Patent: Mar. 20, 2007

(54) POWER ACTUATOR FOR AUTOMOTIVE CLOSURE LATCH

(75) Inventors: Ioan Dorin Ilea, Vaughan (CA); J. R. Scott Mitchell, Ontario (CA)

(73) Assignee: Intier Automotive Closures Inc., New Market (CA)

( * ) Notice: Subject to any disclaimer, the term of this patent is extended or adjusted under 35 U.S.C. 154(b) by 0 days.

(21) Appl. No.: 10/657,707

(22) Filed: Sep. 9, 2003

(65) Prior Publication Data

US 2005/0052032 A1 Mar. 10, 2005

(51) Int. Cl.
*E05C 3/06* (2006.01)

(52) U.S. Cl. ..... 292/201; 292/216; 292/DIG. 23

(58) Field of Classification Search ..... 292/216, 292/201, DIG. 42, DIG. 43, DIG. 23; 70/280–282; 403/329, DIG. 14
See application file for complete search history.

(56) References Cited

U.S. PATENT DOCUMENTS

| | | | |
|---|---|---|---|
| 1,337,235 | A | 4/1920 | Kuhn |
| 1,431,290 | A | 10/1922 | Daggett, Jr. |
| 1,740,971 | A | 12/1929 | Corlett |
| 2,706,957 | A | 4/1955 | Iannetti |
| 2,716,567 | A | 8/1955 | Turcott |
| 2,859,060 | A | 11/1958 | Davies et al. |
| 2,999,712 | A | 9/1961 | Jakeway |
| 3,143,365 | A | 8/1964 | Egger |
| 3,154,333 | A | 10/1964 | Townsend |
| 3,385,620 | A | 5/1968 | Porvin |
| 3,640,560 | A | 2/1972 | Zawadzki et al. |
| 4,059,360 | A | 11/1977 | Teissier |
| 4,135,377 | A | 1/1979 | Kleefeldt et al. |
| 4,200,405 | A | 4/1980 | Bauer |
| 4,269,440 | A | 5/1981 | Gelhard |
| 4,290,634 | A | 9/1981 | Gelhard |
| 4,478,531 | A | 10/1984 | Levinson et al. |

(Continued)

FOREIGN PATENT DOCUMENTS

| | | | |
|---|---|---|---|
| DE | 4119703 | C1 | 10/1992 |

(Continued)

OTHER PUBLICATIONS

International Search Report for PCT patent application No. PCT/CA2004/001596 dated Feb. 1, 2005.

(Continued)

*Primary Examiner*—Brian E. Glessner
*Assistant Examiner*—Christopher Boswell

(57) ABSTRACT

A power actuator for automotive door latches. The actuator includes an electric motor mounted in a housing. A worm is operatively coupled to the motor for driving rotation of the worm about an axis. A worm gear, which meshes with the worm, is mounted to a tubular mount in the housing for rotation about an axis substantially orthogonal to the worm axis. A cam mounted to the worm gear engages the lever of a latch. An integral camshaft depends from the cam and extends into a central aperture on the worm gear, making the rotation axis of the two coincident. The distal end of the camshaft includes at least one resilient finger received through the aperture and in abutting contact with an opposing surface of the gear to preclude axial withdrawal of the camshaft from the wheel aperture. The power actuator uses a reduced number of components.

41 Claims, 10 Drawing Sheets

U.S. PATENT DOCUMENTS

| | | | | |
|---|---|---|---|---|
| 4,573,723 | A | 3/1986 | Morita et al. | |
| 4,617,812 | A | 10/1986 | Rogers | |
| 4,624,491 | A | 11/1986 | Vincent | |
| 4,669,283 | A | 6/1987 | Ingenhoven | |
| 4,674,781 | A | 6/1987 | Reece et al. | |
| 4,708,378 | A | 11/1987 | Ingenhoven | |
| 4,793,640 | A | 12/1988 | Stewart, Sr. | |
| 4,819,493 | A | 4/1989 | Dornan | |
| 4,821,521 | A | 4/1989 | Schuler | |
| 4,885,922 | A | 12/1989 | Lutz | |
| 4,893,704 | A | 1/1990 | Fry et al. | |
| 4,932,277 | A | 6/1990 | Beaux | |
| 4,932,690 | A | 6/1990 | Kleefeldt et al. | |
| 4,978,155 | A | 12/1990 | Kobayashi | |
| 5,037,145 | A | 8/1991 | Wilkes | |
| 5,079,964 | A | 1/1992 | Hamada et al. | |
| 5,106,133 | A | 4/1992 | Fukumoto et al. | |
| 5,137,312 | A | 8/1992 | Tang | |
| 5,193,370 | A | 3/1993 | Norden | |
| 5,328,218 | A | 7/1994 | Brusasco et al. | |
| 5,373,752 | A | 12/1994 | Schlagwein | |
| 5,441,315 | A | 8/1995 | Kleefeldt et al. | |
| 5,472,065 | A | 12/1995 | Vergin | |
| 5,526,710 | A | 6/1996 | Ohta | |
| 5,634,676 | A | 6/1997 | Feder | |
| 5,655,798 | A | 8/1997 | Kaveney et al. | |
| 5,784,832 | A | 7/1998 | LeeVan | |
| 5,855,130 | A | 1/1999 | Rorabacher et al. | |
| 5,909,918 | A * | 6/1999 | Kowalewski et al. | 292/201 |
| 5,951,070 | A * | 9/1999 | Spurr | 292/201 |
| 6,032,760 | A | 3/2000 | Jorgensen | |
| 6,048,002 | A * | 4/2000 | Ohta et al. | 292/201 |
| 6,076,868 | A * | 6/2000 | Roger et al. | 292/201 |
| 6,237,737 | B1 | 5/2001 | Jorgensen et al. | |
| 6,254,418 | B1 | 7/2001 | Tharp et al. | |
| 6,390,517 | B1 * | 5/2002 | Ehret | 292/201 |
| 6,517,128 | B2 | 2/2003 | Perkins et al. | |
| 6,565,131 | B2 | 5/2003 | Roos | |
| 6,568,720 | B1 * | 5/2003 | Szablewski | 292/201 |
| 6,575,506 | B2 * | 6/2003 | Hayakawa et al. | 292/216 |
| 6,641,184 | B2 * | 11/2003 | Erices et al. | 292/216 |
| 6,698,805 | B2 * | 3/2004 | Erices et al. | 292/216 |
| 6,705,649 | B1 * | 3/2004 | Reddmann | 292/216 |
| 6,719,333 | B2 * | 4/2004 | Rice et al. | 292/216 |
| 6,773,042 | B2 * | 8/2004 | Spurr et al. | 292/216 |
| 6,779,942 | B2 * | 8/2004 | Lipp et al. | 403/329 |
| 2002/0096889 | A1 * | 7/2002 | Nelsen et al. | 292/201 |
| 2002/0167177 | A1 | 11/2002 | Erices et al. | |

FOREIGN PATENT DOCUMENTS

| | | |
|---|---|---|
| EP | 0433103 A2 | 6/1991 |
| WO | WO8910458 | 11/1989 |
| WO | WO 02/50445 | 6/2002 |

OTHER PUBLICATIONS

Picture of Power Door Lock Actuator of Rockwell Corp., Troy, MI; on market since at least before Sep. 1, 1994.

Picture of Power Door Lock Actuator of Kelsey-Hayes Co., Romulus, MI: on market since at least before Sep. 1, 1994.

Picture of Power Door Lock Actuator of Ford Motor Co., Dearborn, MI; believed dated before Sep. 1, 1994.

Picture of Power Door Lock Actuator of Chrysler Corp, Highland Park, MI; believed dated before Sep. 1, 1994.

Picture of Power Door Lock Acuator of General Motors Corp., Detroit, MI; build by ITT Automotive, NY; on market since at least before Sep. 1, 1994.

Photograph of Power Door Lock Actuator of Rockwell, Corp, Troy, MI; on market since at least Feb. 13, 1998.

Photograph of Power Door Lock Actuator of Kiekert GmbH & Co.; Heiligenhaus, Germany; on market since before Mar. 1997.

Door Lock Actuator Product of ITT Automotive, Auburn Hills, MI 48236; first publication date unknown.

Door Lock Actuator Product of Delphi Automotive Systems, Pontiac, MI 48340; first publication date unknown.

Door Lock Actuator Product of Gecom, Division of Mitsui Corp., Southfield, MI 48075; first publication date unknown.

Door Lock Actuator Product of Aisin Seiki of Karya City, Japan; first publication date unknown.

Door Lock Actuator Product of either Rockwell-Meritor of Troy, MI 48084 or Bosch of Broadview, IL 60153; first publication date unknown.

Door Lock Actuator Product Part F812-25218A43-AA of Ford Motor Co., Dearborn, MI; dated Oct. 1998.

* cited by examiner

POWER ACTUATOR FOR AUTOMOTIVE CLOSURE LATCH

FIELD OF THE INVENTION

This invention generally relates to power actuators for vehicle latches, as for example to a power actuator for releasing a trunk latch or a power actuator for moving a lock lever between a locking and unlocking position.

BACKGROUND OF THE INVENTION

Cost is an important factor for manufacturing vehicle accessories such as motorized latch release devices. The number of parts which compose a power actuator has a bearing on the cost of the product. Heretofore, known power actuators for automotive closure latches have more parts, and thus likely higher cost, than the present invention.

SUMMARY OF THE INVENTION

A power actuator for automotive closure latches according to the preferred embodiment of the invention has a reduced number of components in comparison to comparable devices currently on the market.

According to one embodiment of the invention, a power actuator is provided which includes a housing having a recessed region and a tubular mount extending from the center of the recessed region. An electric motor is mounted in the housing with a worm operatively coupled to the motor for driving rotation of the worm about an axis in a first rotational direction. A worm gear, in meshing engagement with the worm, is rotatably mounted to the tubular mount for rotation about an axis substantially orthogonal to the worm axis, A camshaft is mounted on the worm gear and has a rotation axis coincident with the gear axis. The camshaft has a distal end; and an output arm affixed at the distal end of the camshaft.

The power actuator may be employed as a latch release device. According to this embodiment, the latch release device includes a housing having a recessed region and a tubular mount extending from the center of the recessed region. An electric motor is mounted in the housing with a worm operatively coupled to the motor for driving rotation of the worm about an axis in a first rotational direction. A worm gear, in meshing engagement with the worm, is rotatably mounted to the tubular mount for rotation about an axis substantially orthogonal to the worm axis. A cam is mounted to the worm gear by an integral depending camshaft so that the rotation axis of the camshaft is coincident with the gear axis. Preferably, at least one resilient finger is provided at the distal end of the camshaft in abutting contact with a surface of the gear facing away from the cam to preclude axial withdrawal of the camshaft from the gear aperture. The cam has a surface for engaging a latch to move the latch from a closed position to a release position as the gear rotates in a first direction from a first position to a second position when driven by the motor.

In a preferred embodiment of the latch release device, the worm has a small diameter worm, efficient for the overall size of the device. The combination of an output cam with a gear reduction stage results in high overall force output as well.

In the preferred embodiment of the latch release device, the worm gear is biased against the rotation from the first position to the second position. The ability to implement a biasing return spring provides repeatable uni-directional force output, and without such a spring, bi-directional torque/force output.

In a particular embodiment, the device includes electrically conductive contacts embedded into the housing as the housing is molded from plastic resin, to be in electrical contact with the motor and the same time extending to the exterior of the housing for connection to an electric power supply. The integration of an electrical connector is another example how further functionality without additional components or complexity can be obtained by means of the invention described herein.

The housing of the latch release device can include an injection-molded closure plate, wherein a hollow portion of the housing and the plate have opposing walls shaped to abut a housing of the motor when the hollow portion and the plate are secured together, and the plate further includes protrusions which extend into the housing interior to abut sides of the motor housing to preclude movement therepast.

In another preferred aspect, the closure plate and housing include a plurality of holes in communication with each other and located to permit simultaneous fastening of the housing and closure plate together and fastening of the device adjacent a latch with the cam in operable proximity thereto. This arrangement permits utilization of the same fasteners which mount the unit to a host latch or mechanism to also bind the housing components of the device together. The preferred embodiment thus provides a highly versatile, customizable, compact, low-cost mechanism for power release or locking.

BRIEF DESCRIPTION OF THE DRAWINGS

Detailed embodiments of the invention are described below with reference to the accompanying drawings in which.

DETAILED DESCRIPTION OF THE INVENTION

Figure 1A:
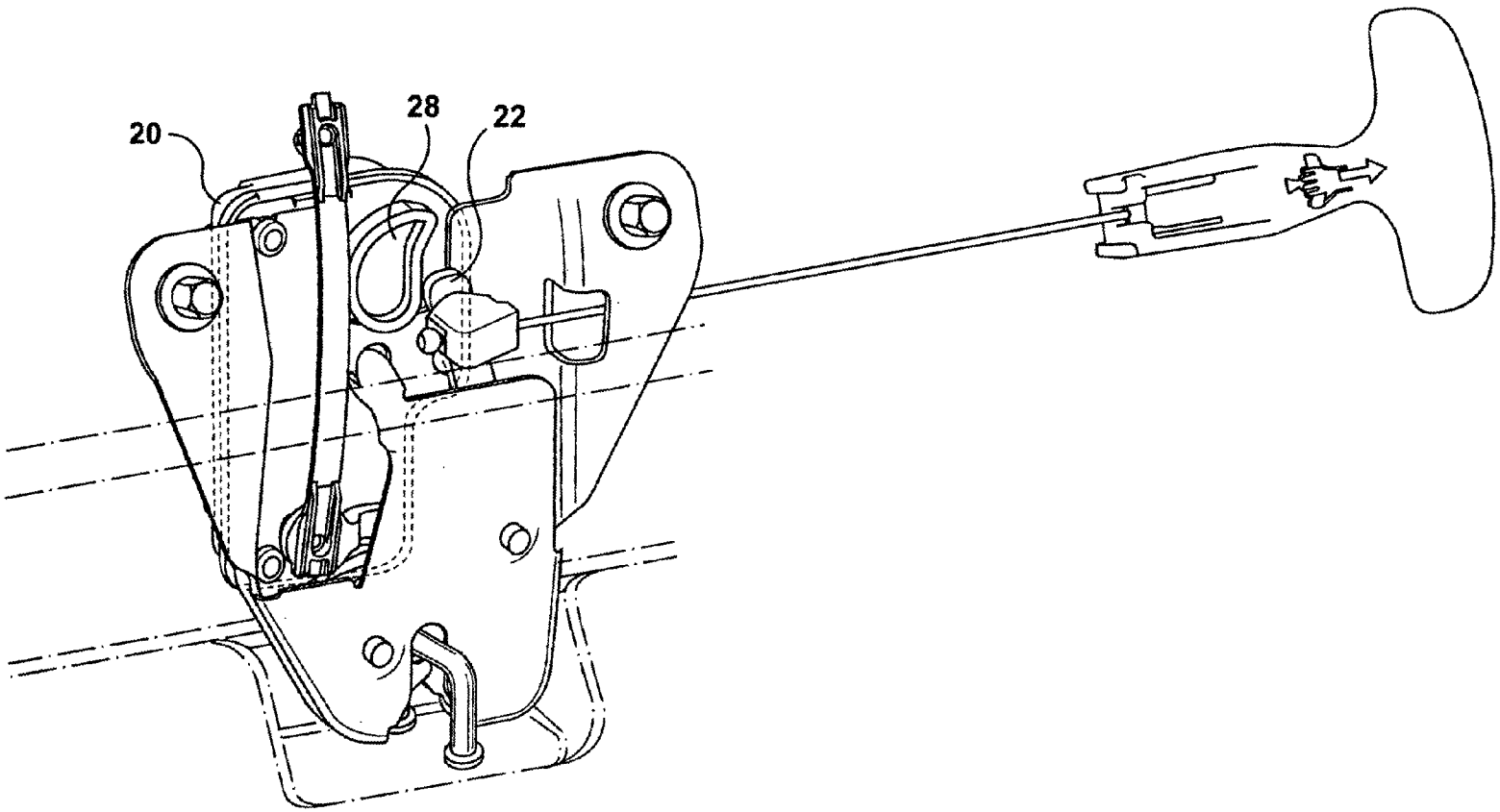
FIG. 1*a* is a perspective view of a motorized latch release device of the present invention installed on an automobile, in a closed position.
Figure 1B:
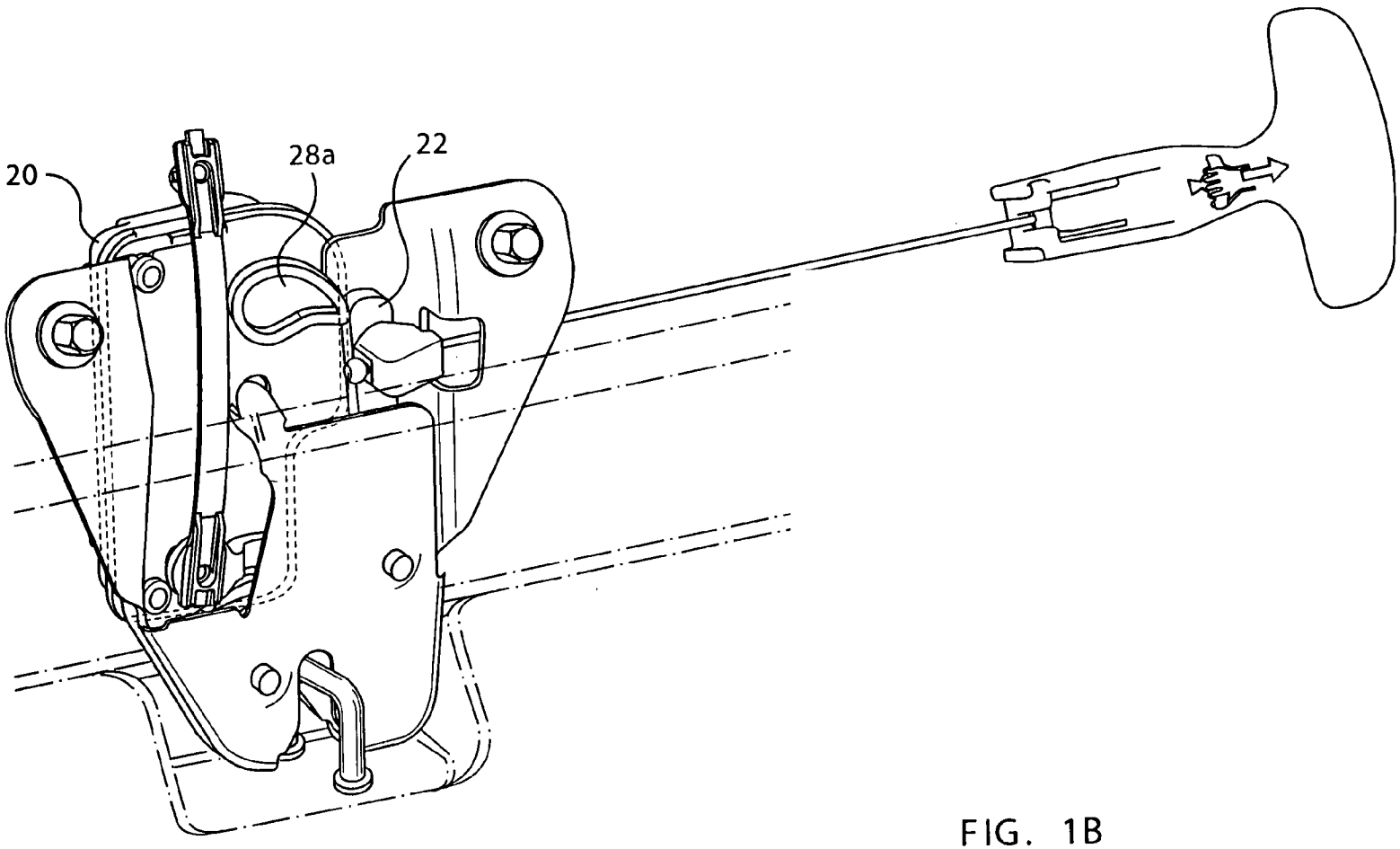
FIG. 1*b* is similar to FIG. 1*a* in which the motorized latch release device is in an open position.

Turning to the drawings, a motorized latch release device 20 of the present invention is shown generally in FIGS. 1*a* and 1*b*. In the figures, the device is shown installed on an automobile to permit remote-controlled trunk release by a driver. As illustrated in FIG. 1*a*, the trunk is in the closed and locked position. Latch 22, part of a conventional trunk locking mechanism, is biased in the clockwise direction. Generally speaking, device 20 operates through rotation of an output cam 28 from a closed position shown in FIG. 1*a* to an open position shown in FIG. 1*b*. This counterclockwise rotation (as viewed in FIGS. 1*a* and 1*b*) forces latch 22 rightward from its closed position into a release position, as illustrated by the latch positioned in FIG. 1*b*. The output cam 28 automatically rotates back to the closed position of FIG. 1*a* after reaching the fully open position. A detailed description of device 20 and its operation is given below.

Figure 2:
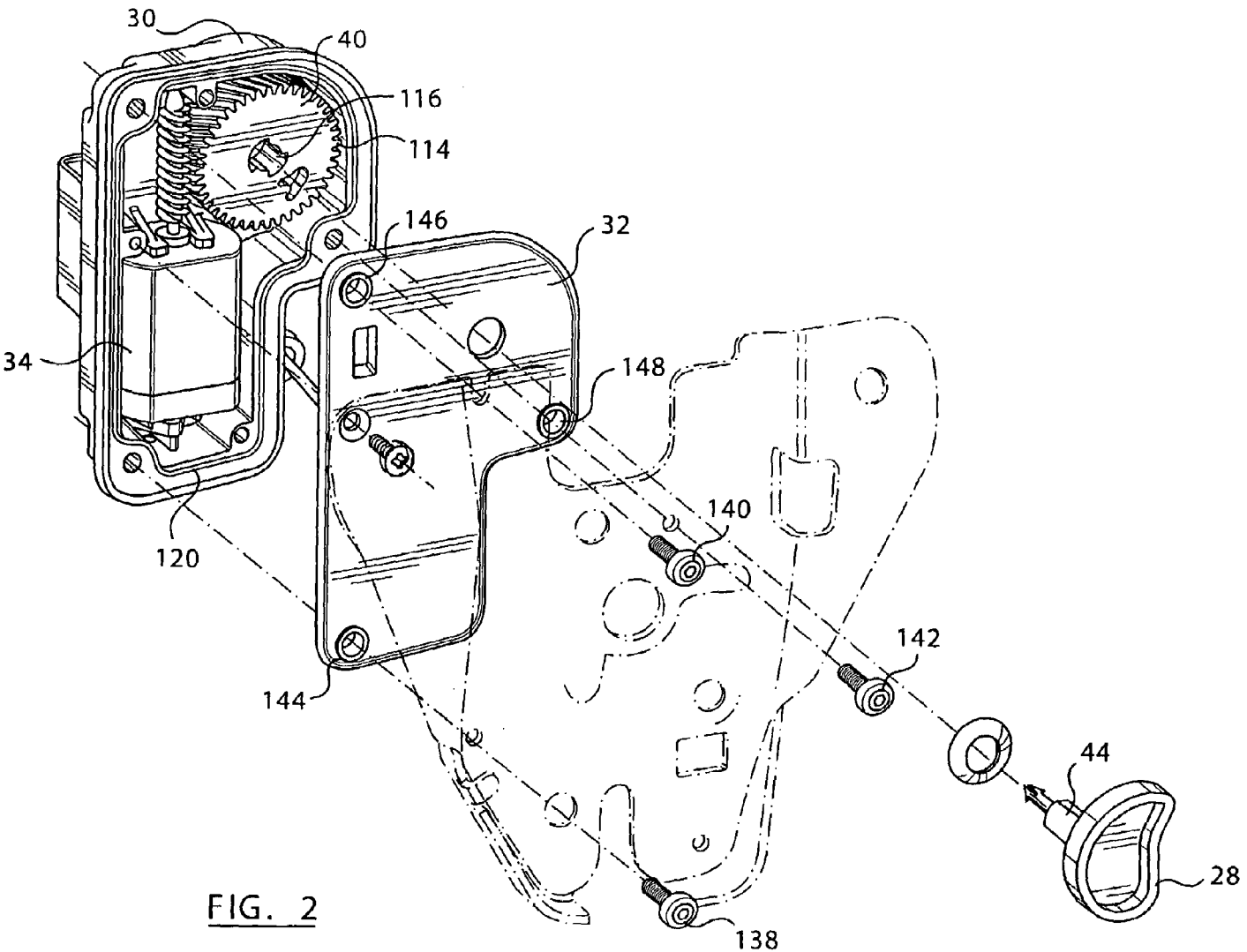
FIG. 2 is a partially exploded view taken from a vantage point similar to that of the previous figures, having the cover plate of the latch release device removed and partially exploded to reveal the electric motor and worm gear arrangement of the mechanism.
Figure 3:
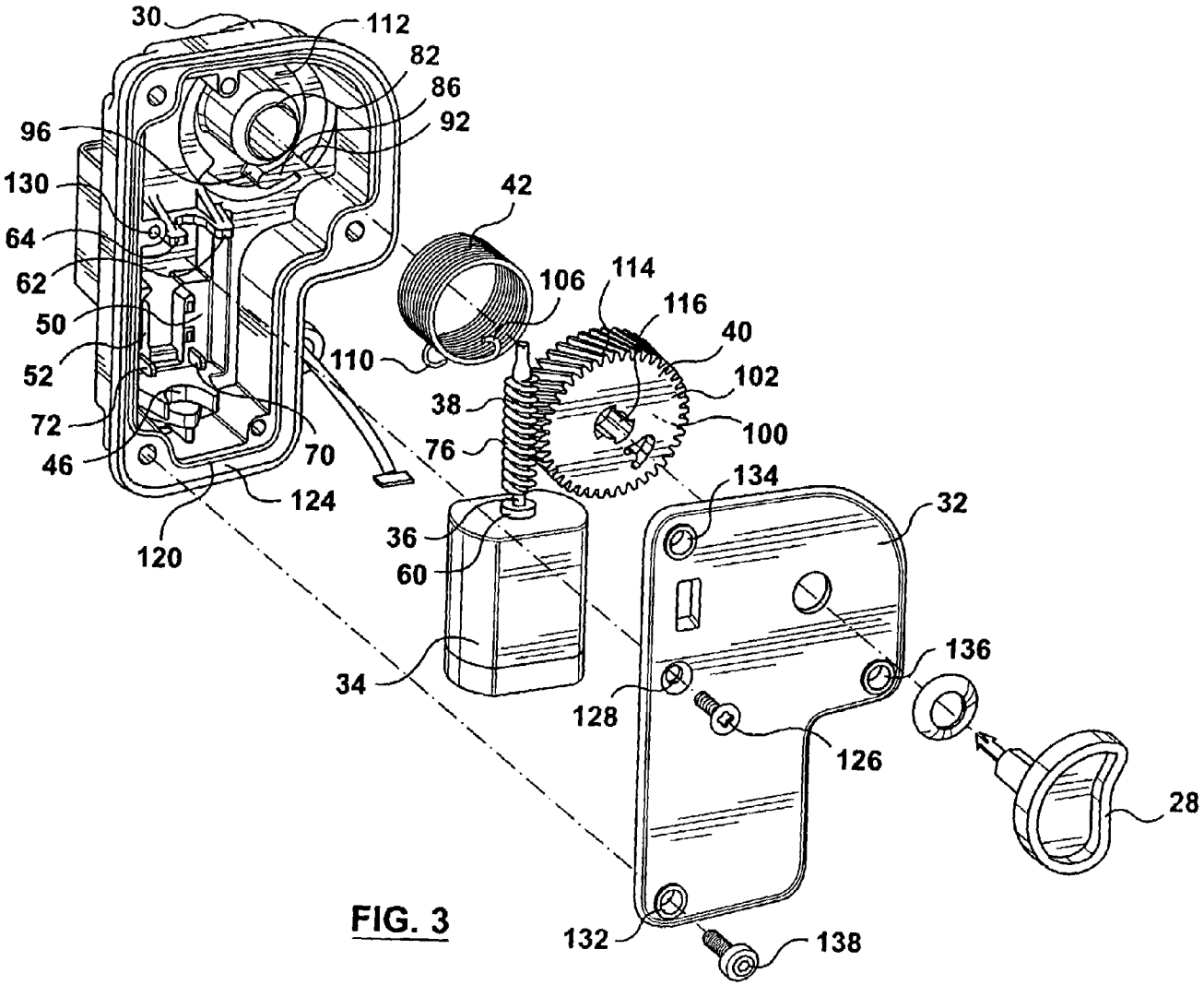
FIG. 3 is a more fully exploded view taken from a vantage point similar to that of the previous figures, to reveal the inner housing, worm wheel and spring for biasing the worm wheel towards the closed position, and the seating area for the motor.

As shown in FIGS. 2 and 3, the device includes a hollow housing 30 and a closure plate 32. Each of these members is injection-molded as single piece of plastic in a one-step process. Integrally molded as part of the housing and affixed within the plastic are electrical connectors, described further below, for connecting an electrical motor 34 of the device to an external power supply. The housing and closure are composed of a suitable plastic, in this case a glass and mineral-reinforced nylon resin. The polymers are generally selected for high strength and stiffness, dimensional stability and resistance to temperature extremes.

As can be seen in FIGS. 2 and 3, the electric motor 34 includes an output shaft 36 which drives a worm 38 mounted to the external end of the shaft. The device includes a worm gear 40 in meshing engagement with the worm, a helical spring 42, and a cam shaft 44 upon which the output cam 28 is mounted. As described in greater detail below, these components are arranged such that the spring biases the worm gear, and hence the output cam, in the counterclockwise direction (as viewed in FIGS. 1*a* to 3), towards the closed position. The motor operates via the worm to drive the worm gear in the clockwise direction, i.e., towards the open position shown in FIG. 1*b*.

Figure 7:
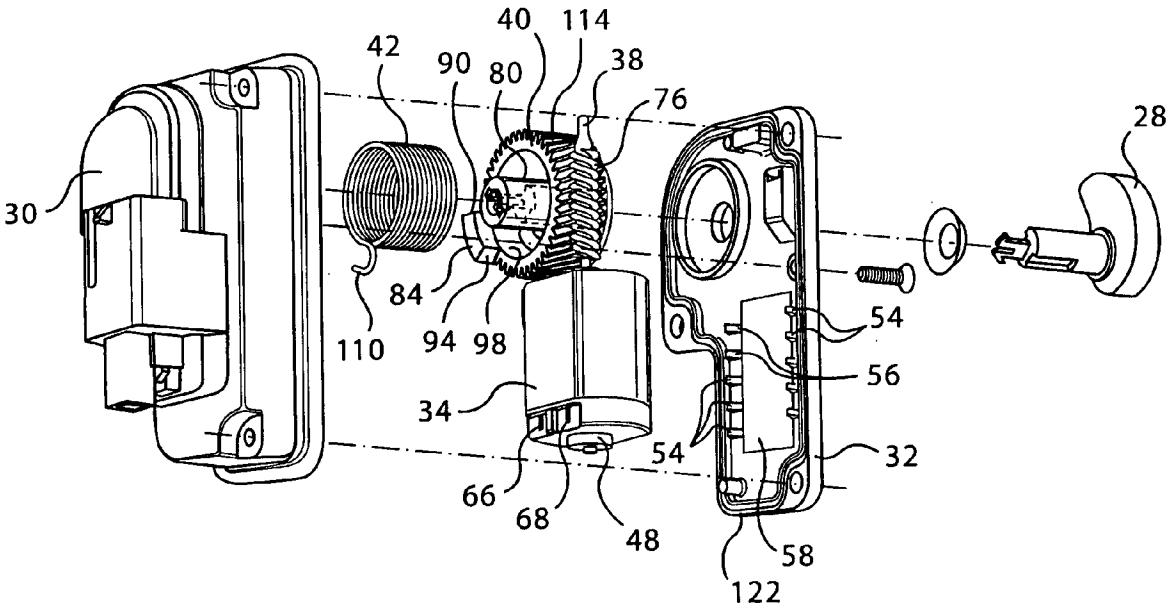
FIG. 7 is perspective view from a vantage point similar to that of FIG. 6, partially exploded to show the motor and cover plate.
Figure 6:
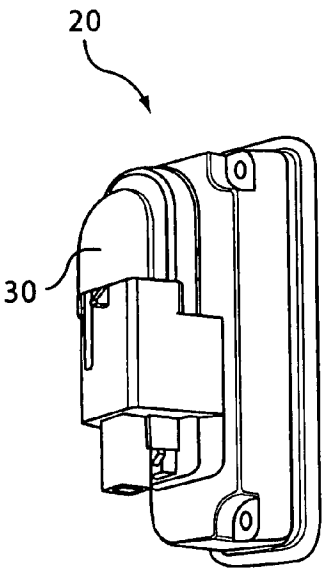
FIG. 6 is a perspective view of the exterior of the housing opposite of that shown in FIG. 1.
Figure 8:
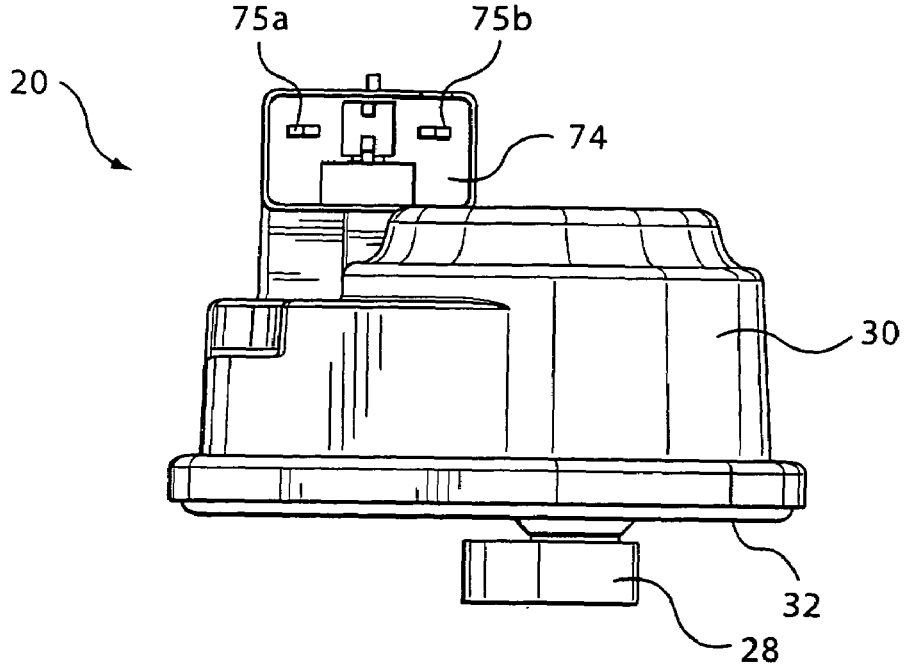
FIG. 8 is a top plan view of the device, as oriented in FIG. 1.
Figure 9:
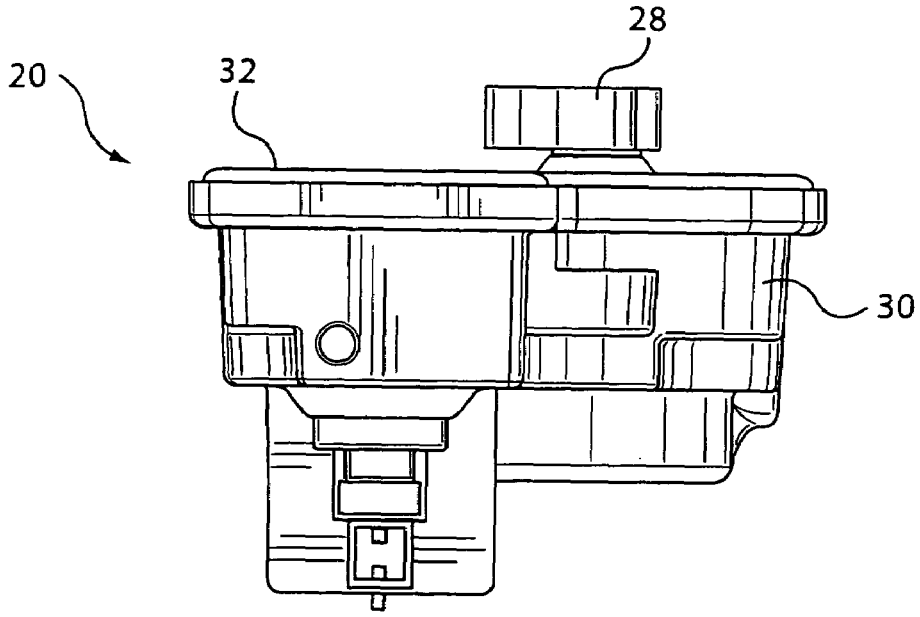
FIG. 9 is a bottom plan view of the device, as oriented in FIG. 1.
Figure 11:
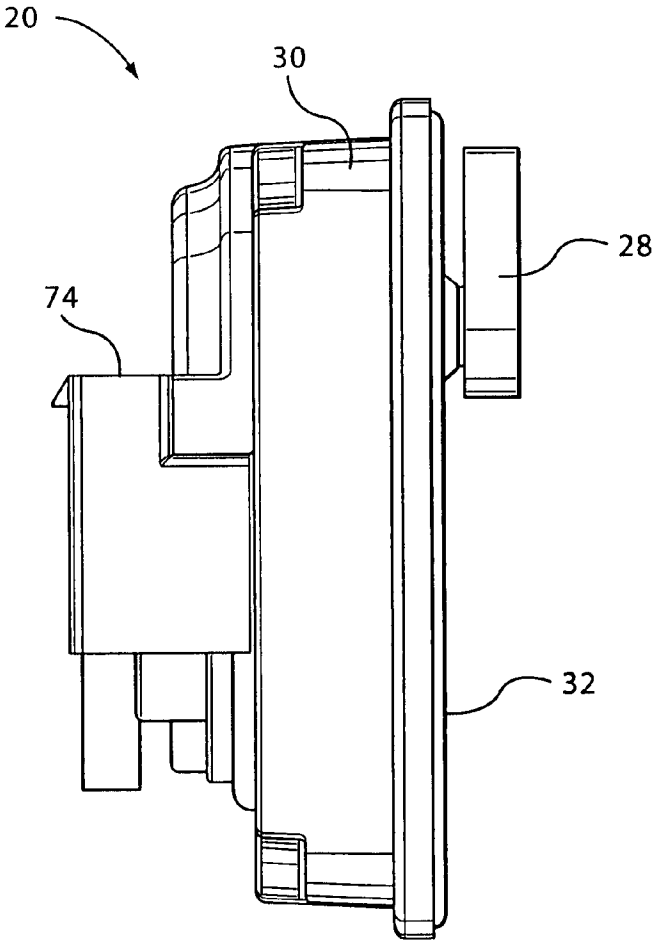
FIG. 11 is a left end view elevation of the device, as oriented in FIG. 1.
Figure 10:
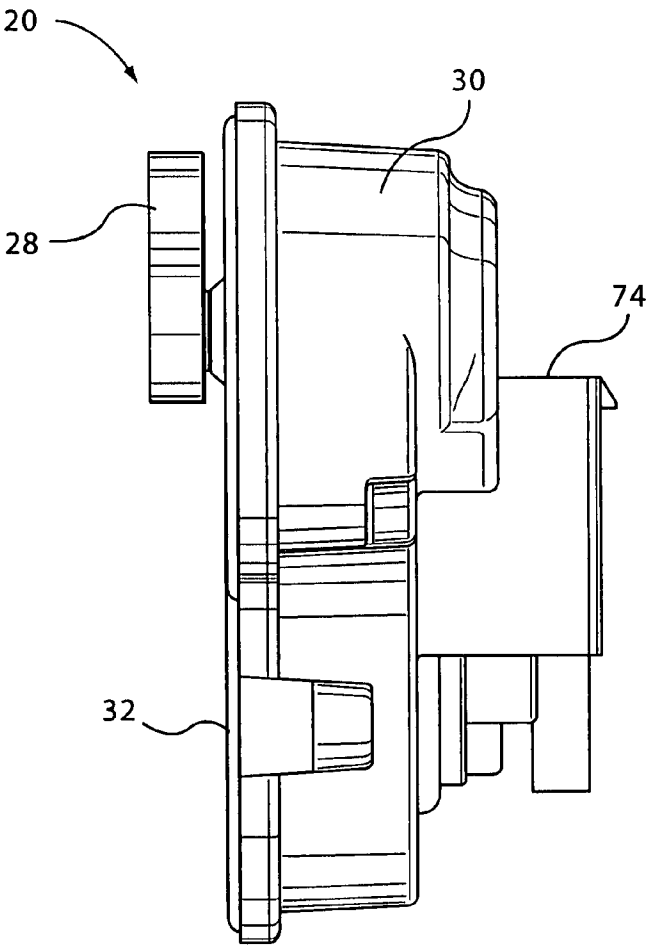
FIG. 10 is a right end view elevation of the device, as oriented in FIG. 1.
Figure 12:
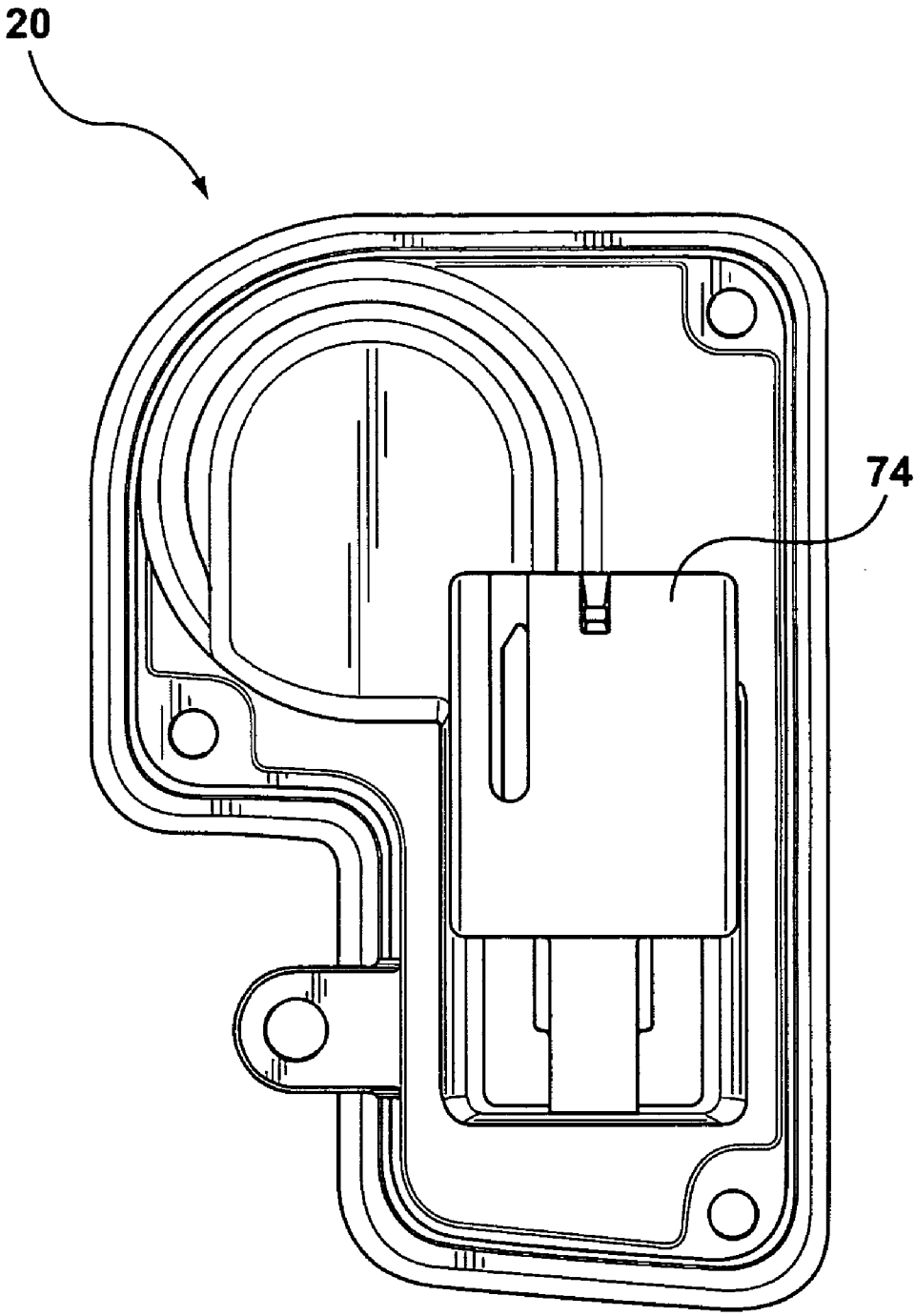
FIG. 12 is a rear elevation of the device, as oriented in FIG. 1.
Figure 13:
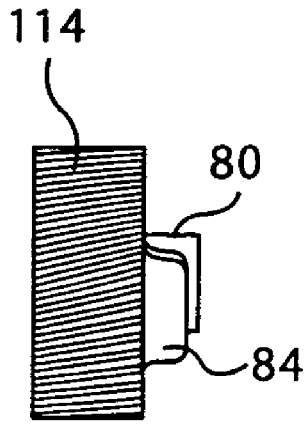
FIG. 13 is a plan view of the worm wheel, as viewed from the left of FIG. 7.

Electric motor 34 is a high-torque output, low cogging torque 200-series motor with integrated thermal protection, EMC protection and a knurled shaft. Such motors are available, for example, from Mabuchi Motor Co., Ltd. or Johnson Electric North American, Inc. The motor is mounted in a fixed position within the housing, being held in place by positive abutment with surfaces of the housing and closure plate. A cylindrical stub 48 (see FIG. 7) of the motor is seated against a concave surface 46 of the housing. The motor housing abuts directly against first and second surfaces 50, 52. On the inside of closure plate 32 are two rows of triangular protrusions 54 having facing surfaces 56 located and oriented so as to, with inner surface area 58 of the plate, abut against the motor housing. Cylindrical stub 60 is received between upstanding members 62, 64 of the inner housing of the device, the side surfaces of each member being in abutment to help hold the shaft end of the motor from moving to the right or left, as oriented in FIG. 1. The motor includes first and second openings 66, 68 having electrical terminals disposed therein. Contact posts 70, 72 are molded into the housing and received within the openings 66, 68 of the motor each in abutting electrical contact with a terminal of the motor.

The housing includes a socket 74 having first and second prongs 75*a*, 75*b* molded externally as part of the rear (as oriented in FIG. 1) of the housing. Each of the prongs is electrically connected by an embedded conductor to posts 70, 72. Preferably, the socket and prongs are designed to receive a standard plug for supplying electrical power to the motor of the latch release device. However, any suitable form of electrical connector will suffice.

Turning back to the drive mechanism for the device, the drive end of the shaft 36 extends about 1.5 cm beyond the end of cylinder 60 in which it is suitably journaled. The free end of the shaft has knurled ridges (not illustrated), parallel to the lengthwise axis of the shaft, pressed into it for a length of about 7 mm. The worm 38 is tubular, having an inner diameter slightly less than the outer diameter of shaft 36 so that receipt of the worm onto the shaft results in a snug fit sufficiently tight for the expected life of the device. The ridges on the shaft are deformed radially inward slightly during assembly of the worm onto the shaft and the ridges help to ensure that the worm is rigidly affixed to the shaft so as not to rotate with respect to the shaft during operation of the device.

Worm gear 40 is preferably injection molded in a single step of a homopolymer acetal selected for its low friction, high wear resistance and dimensional stability properties. Alternative materials are possible. The gear is molded to include a tubular mounting shaft 80 (see FIG. 7). The shaft 80 is received into the open end of a cylindrical mount 82 that is integrally molded in the housing 30. Shaft 80 has an external diameter of about 1 cm. The diameter of the shaft 80 and the internal diameter of the cylindrical mount 82 are closely dimensioned to each other so that there is very little play between the two pieces, but at the same time the worm gear is free to rotate with respect to the cylindrical mount 82. The abutting surfaces are very smooth, of circular cross-section, and present minimal frictional resistance to rotational movement of the gear about the central axis of the shafts.

In the illustrated embodiment the outer diameter of worm gear 40 is about 2.7 cm, and the width of the wheel rim, i.e., the tooth bearing portion of the wheel, is about 1.1 cm, with the total height of wheel shaft 80 being about 1.6 cm. A stop 84 is molded as part of the worm gear. The stop 84 protrudes from the toothed rim a distance of about 4 mm and extends around the circumference of the rim a distance of about 45 degrees. This stop can be omitted in the case that full 360 degree output rotation is desired. A stop 86, molded as part of the housing, is radially spaced from the center of mount 82 a slightly smaller distance than the radial distance between worm gear stop 84 and the center of shaft 80. Housing stop 86 and wheel stop 84 together govern the rotational (angular) distance that the worm wheel is permitted to travel between the closed position (FIG. 1*a*) and the open position (FIG. 1*b*), the rotational distance being about 270°. The length of the arc on which housing stop 86 lies is about 45° and the length of the arc on which the worm wheel stop 84 lies is about 45° so that together the two stops together extend about 90° along the common circle on which they together lie. When worm gear 40 is properly mounted and occupying the closed position, abutment surface 90 of the gear stop and abutment surface 92 of the housing stop abut each other to preclude clockwise rotation of the gear. When the gear is rotated counterclockwise to the extreme open position (see FIG. 1*b*) abutment surfaces 94 and 96 of the gear stop and housing stop, respectively, come into abutment with each other so as to preclude further counterclockwise movement of the gear. Because the combined distance of the two stops is 90° of the common circle on which the two stops lie, the rotation of the gear between the closed position and the open position totals 270°. As will be seen further below this is the rotational (angular) distance traveled by cam 28 in operation of the device in releasing the latch.

Worm gear 40 is biased towards the closed position by the helical spring 42. Spring 42 is installed within the generally toroidal space located between inner surface 98 of wheel rim, the outer surface of gear shaft 80 and inner surface 100 of gear wall 102. Located within the toroidal space is a protrusion 104 which stands out from the gear wall and serves as a catch for hooked end 106 of the spring. Protrusion 104 includes overhang 108. By precluding axial movement of the hooked portion of the spring (as in the direction parallel to the central axis of the wheel and away from inner wall 102), overhang 108 aids in the installation of the spring during assembly of the device, and helps to ensure that hook 106 of the spring does not slip past the catch during operation of the device. Spring end 110 is in the shape of a hook to latch onto housing surface 96. It is noted here that gear stop 84 is generally radially spaced outwardly of spring 42, but that hook 110 protrudes radially outwardly from the remainder of the spring so as to latch onto surface 96, which is itself radially located to abut surface 94 of the stop of the wheel. Clearance for travel of stop 84 past hook 110 as the wheel rotates into the closed position is provided by locating the hook in recess 112 which encircles cylindrical mount 82 and extends radially outwardly in the neighborhood of stop 86, as illustrated in FIG. 3. Hook 110 is thus axially spaced from stop 84 (toward the floor of the housing) to provide for travel of stop 84 past hook 110.

The spring 42 is installed so as to be under constant tension and is preferably made of spring steel or stainless steel. This results in the worm gear being constantly biased towards the closed position, i.e., in the clockwise direction as viewed in either of FIG. 1*a* or 1*b*, for example. As the gear is rotated under force provided by the motor through the worm (described in greater detail below), the tension on the spring increases.

Figure 4:
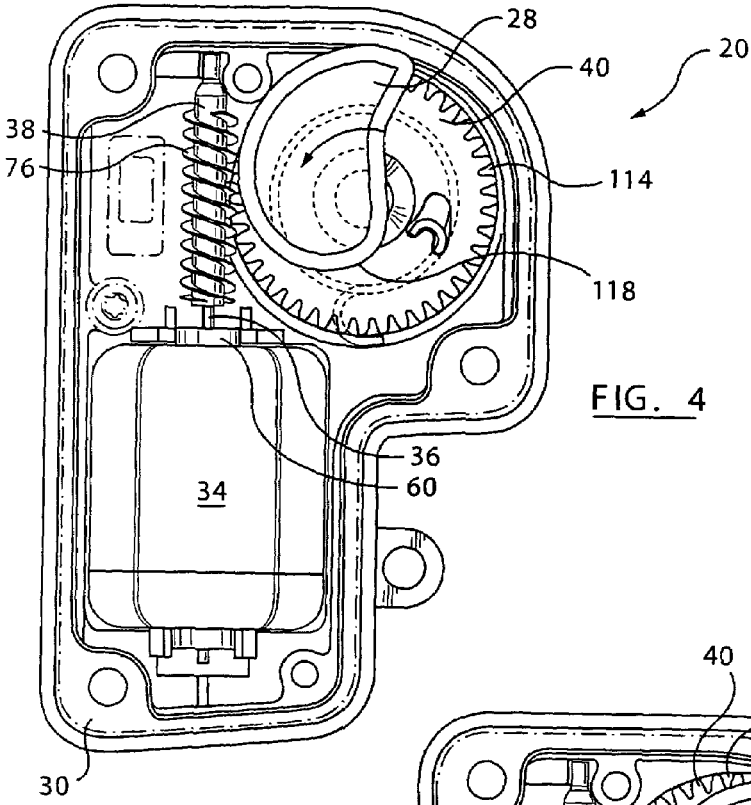
FIG. 4 is a plan type of view of the housing, spring and worm wheel with the worm wheel in the closed position.
Figure 5:
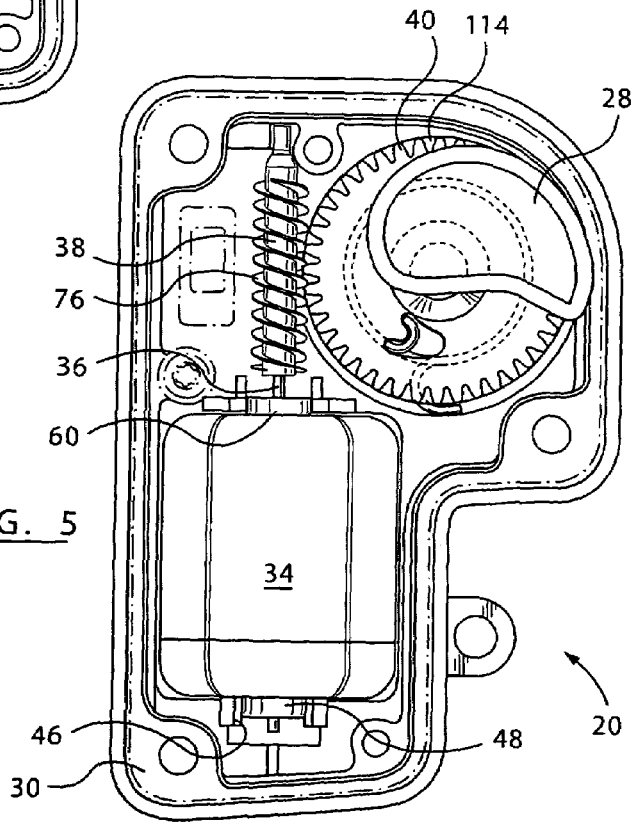
FIG. 5 is similar to FIG. 4, but with the worm wheel fully rotated into the open position shown in FIG. 1.

The motive force of motor 34 is transferred to worm gear 40 by worm 38. Thread 76 of the worm engages teeth 114, which have an axial pitch and lead designed to mesh with the axial pitch and lead of the worm thread. Thus activation of motor 34 results in clockwise rotation of worm 38 (as viewed from the left in FIG. 1*a*), which in turn causes rotation of worm gear 40 in the counterclockwise direction, as viewed in FIG. 1*a*. Activation of motor 34 by application of appropriate electrical current can be instituted as by an appropriately wired button located for access by the driver, or by an activation circuit under remote control, etc. In the position of FIG. 4, the torque on the worm wheel from the spring is about 330 Nmm, and the torque from the spring is about 380 Nmm when the worm wheel is in the position shown in FIG. 5.

Rotation of worm gear 40 will eventually be halted by abutment of stop surfaces 94, 96 when the gear has rotated through an angle of about 270° to the fully open position, as previously described. Halting the gear rotation prevents the worm from turning, and hence causes motor 34 to stall. The power supplied to the motor is cut off and the stored energy in the coiled spring causes the worm gear to rotate back to the closed position.

The worm gear 40 has a central aperture 116 which receives a shaft 44 attached to cam 28. The cam and shaft are injected molded as a single piece of the same type of plastic as the worm gear. The exterior profile of the cross-section of shaft 44 matches the cross-section of central aperture 116 of the gear and the cross-sections are non-circular. Shaft 44 received into the aperture is thus fixed against rotation with respect to the axis of the worm gear. Installed shaft 44 is also centered on the central axis of the worm gear so that when the gear rotates about the axis so too does the cam shaft. It will further be noted that the engagement of surfaces of the shaft 44 and aperture serve to orient the cam for operation between the closed and open positions.

Figure 14:
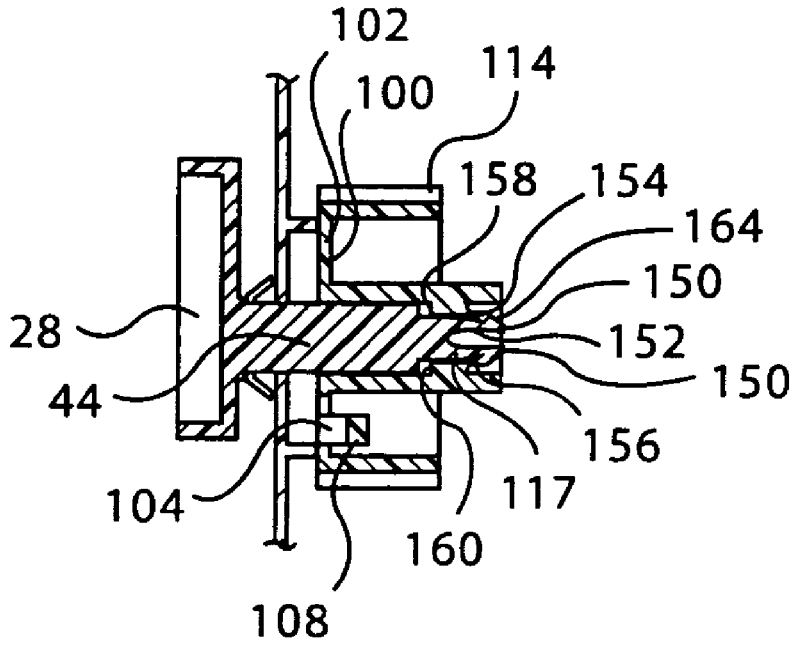
FIG. 14 is a sectional elevation of the worm wheel showing the cam installed therewith.

Cam 28 is installed as part of the device after assembly of the closure and housing, described further below. This is accomplished through tabs 150 at the free end of shaft 44. Each tab is located at the end of finger 152, the fingers being radially spaced apart from each other on opposite sides of the central axis of shaft 44. Each tab includes abutment surface 154 which opposes and abuts surface 156 surrounding the central aperture of worm wheel 40. Opposing tab surfaces 154 is surface 158 of shaft 44, surface 158 being in abutment with surface 160 of the worm gear. Thus, for installation, cam shaft 44 is inserted through aperture 162 and into worm wheel aperture 116. Chamfered lead surfaces 164 of the tabs abut against inner surfaces of narrowed portion 117 of aperture 116 squeezing the resilient fingers together as they pass through the narrowed passage, eventually springing apart into the installed position shown in FIG. 14 in which surfaces 154, 156 abut each other, and surfaces 158, 160 abut each other, to affix the cam against axial movement with respect to the worm wheel.

The cross-sectional profile of the cam surface is wing-shaped. Translation of the rotational motion of the cam shaft 44 through the cam surface to move latch 22 from the closed position to the release position is illustrated in FIGS. 1*a* and 1*b*. As shaft 44 rotates, the cam surface area generally designated as 118 contacts latch 22. As this rotation occurs, the radial distance (from the center of shaft 44) of the contact portion of the cam surface with the latch is in contact increases resulting in forced movement of the latch from the closed position towards the release position. As described above, the worm gear and affixed cam rotate until the fully open position 28*a* (FIG. 1*b*) is reached and motor 34 stalls, which stall leads to the eventual return of the cam to the closed position.

The cam profile converts the output torque to a linear force pushing against a movable lever, plate or other feature to which one desires a force to be applied. This cam functions as a further gear ratio for the system, where smaller distances pushed by the full rotation of the cam are seen to result in higher applied forces by the cam.

It is possible that the installed device could be exposed to minor amounts of water from time to time, as when a trunk was opened during a rainstorm, etc. To lessen the possibility of damage from such exposure, a liquid flow path for such liquids is provided around the periphery of the plate closure edge. Ridge 120, molded as part of housing 30, and ridge 122, molded as part of the closure plate 32 are thus shaped to abut against opposing surfaces (of the closure plate and housing, respectively) to provide a limited seal against ingress of water. Further, the ridges are spaced slightly inwardly from the extreme periphery so that a liquid flow passage 124 is defined around the periphery of the ridges.

Housing 30 and closure plate 32 are conveniently assembled together during manufacture of device 20 through a single assembly screw 126 received through plate aperture 128, the screw shaft being received into housing aperture 130. Aperture 130 is of smaller cross-section than the shaft of the screw so that the threads of the screw become embedded in the plastic wall of the housing during assembly.

The housing and plate have a further three pairs of communicating apertures 132, 134, 136. These apertures are used during installation of the device onto the automobile latch by fasteners 138, 140, 142. Areas 144, 146, 148 of the external plate surface surrounding the apertures are in positive abutting contact with surfaces of the automobile when installed. (This could equally apply to external areas of the housing surround the apertures.) In this way, when the device is installed with the remainder of the latch, compressive forces are further applied to the housing and closure by their being sandwiched between the heads of fasteners 138, 140, 142 and auto surfaces with which plate areas 144, 146, 148 are in positive abutting contact.

Spring 42 of the illustrated device can be omitted, which of course would free the worm wheel from biasing. In such situation, the control circuitry for the device may be modified to drive the motor in first and second directions so as to move the cam from the first to the second (nominally open to the closed) positions illustrated in FIGS. 1*a* and 1*b*, respectively, and to move the cam from the second to the first positions. The device could thus alternatively be used, for example, to positively move a latch between first and second positions, e.g., a lock lever may be moved between locked and unlocked positions. It will be appreciated that the cam or other output arm may have a different profile for different applications.

The illustrated embodiment has been described with particularity for the purposes of description. Those skilled in the art will appreciate that a variety of modifications may be made to the embodiment described herein without departing from the spirit of the invention.

The invention claimed is:

1. A device for releasing a latch comprising:

a housing having a recessed region and a tubular mount extending from the center of the recessed region;

an electric motor mounted in the housing;

a worm operatively coupled to the motor for driving rotation of the worm about an axis in a first rotational direction;

a worm gear, in meshing engagement with the worm and rotatably mounted to the tubular mount and being mounted in the housing for rotation about an axis substantially orthogonal to the worm axis;

a camshaft mounted on the worm gear and having a rotation axis coincident with the gear axis, the camshaft having a distal end extending to the exterior of the housing;

a cam affixed at said distal end of the camshaft, having a surface for engaging the latch to move the latch from a closed position to a release position as the gear rotates in a first direction from a first position to a second position under control of the motor; and wherein the worm gear is biased against the rotation from the first position to the second position by a spring connected between the gear and the housing such that energy is transferred from the motor to the spring as the gear rotates from said first position to said second position under control of the motor and, when the motor is powered down, the energy stored in the spring causes the gear to rotate in a second direction, opposite to the first direction, from the second position to the first position.

2. The device of claim 1, wherein the tubular mount includes an open end facing towards the worm gear, and the worm gear includes a shaft extending into the open end, and an outer rim spaced from the shaft by a gear wall.

3. The device of claim 2, wherein the spring is a helical spring located between the tubular mount and the rim on the worm gear.

4. The device of claim 3, wherein the worm, the worm gear and the spring are located within the housing.

5. The device of claim 4, wherein the spring is a helical spring located between the tubular mount and the rim on the worm gear.

6. The device of claim 2, wherein the housing includes a first stop and a second stop unitarily molded therewith, and the gear includes a first stop and a second stop, wherein when the gear is in the first position, the first stops are in mutual abutment to preclude rotation in the second direction, and when the gear is in the second position, the second stops are in mutual abutment to preclude rotation in the first direction.

7. The device of claim 6, wherein the device further comprises an injection-molded closure plate, and the housing includes a hollow portion and the housing and plate have opposing walls shaped to abut a housing of the motor when the hollow portion and the plate are secured together, and the plate further includes protrusions which extend into the housing interior to abut sides of the motor housing to preclude movement therepast.

8. The device of claim 7, wherein the hollow portion includes an upstanding peripheral ridge unitarily molded therewith, and shaped to abut an inner surface of the plate, and the plate of the housing includes an upstanding peripheral ridge unitarily molded therewith and shaped to abut an inner surface of the housing, to protect against the egress of water into the interior of the housing, and wherein the ridges are located to provide a water flow path around the outer periphery thereof.

9. The device of claim 8, wherein the housing plate includes an aperture in communication with the central aperture of the gear, to permit passage of the camshaft therethrough, and wherein the distal end of the camshaft includes at least one resilient finger received through the communicating apertures and having a surface in abutting contact with an opposing surface of the gear to preclude axial withdrawal of the camshaft from the gear aperture.

10. The device of claim 9, wherein said cam surface for engaging the latch is oriented to move the latch in a direction having a vectorial component non-parallel to the direction of rotation of the gear shaft as the gear rotates in said first direction.

11. The device of claim 9, wherein the at least one resilient finger includes a tab extending out radially from the axis of the camshaft, and the tab provides the surface in abutting contact with the surface of the gear that faces away from the cam.

12. The device of claim 11, wherein the at least one resilient finger includes at least two resilient fingers spaced apart from each other on opposing sides of the central axis of the camshaft.

13. The device of claim 12, wherein the tab includes a chamfered surface to facilitate entry of the resilient finger into the aperture.

14. The device of claim 13, wherein the tabs on the at least two resilient fingers squeeze together when entering the aperture, and then return to their spaced position outside the aperture so that the tabs provide the surface in abutting contact with the surface of the gear that faces away from the cam.

15. The device of claim 7, further comprising electrically conductive contacts embedded into the housing as the housing is molded, in electrical contact with the motor, and extending to the exterior of the housing for connection to an electric power supply.

16. The device of claim 7, wherein the housing and the closure plate include a plurality of holes in communication with each other and located to permit simultaneous fastening of the housing and closure plate together and fastening of the device adjacent said latch with the cam in operable proximity thereto.

17. The device of claim 6, wherein the worm gear includes a catch for retaining a first end of the spring.

18. The device of claim 17, wherein the catch includes an overhanging portion operable to retain the spring during the assembly of the latch release device.

19. The device of claim 17, wherein one of the first and second stops formed in the housing is adapted to retain a second end of the spring.

20. The device of claim 1, wherein the camshaft depends from a center point of the cam so that when the cam is mounted to the worm gear, the two are coaxial.

21. A device for releasing a latch comprising:

a housing having a tubular mount extending into the housing interior an electric motor mounted in the housing;

a worm operatively coupled to the motor for driving rotation of the worm about an axis in a first rotational direction;

a worm gear, in meshing engagement with the worm, and being rotatably mounted in the housing on the tubular mount for rotation about an axis substantially orthogonal to the worm axis;

a camshaft mounted on the worm gear and having a rotation axis coincident with the gear axis, the camshaft having a distal end extending to the exterior of the housing;

a cam affixed at said distal end of the camshaft, having a surface for engaging the latch to move the latch from a closed position to a release position as the gear rotates in a first direction from a first position to a second position under control of the motor; and a spring connected between the gear and the housing so as to bias the worm gear against rotation from the first position to the second position and such that energy is transferred from the motor to the spring as the gear rotates from said first position to said second position under control of the motor and, when the motor is powered down, the energy stored in the spring causes the gear to rotate in a second direction, opposite to the first direction, from the second position to the first position.

22. The device of claim 21, wherein a cross-section of the cam shaft and the aperture are noncircular, the cross-sections of the camshaft and the aperture orienting the cam for operation between the open and the closed positions.

23. The device of claim 21, wherein the worm gear comprises a shaft rotatably mounted to the housing, and an outer rim spaced from the shaft, the rim bearing teeth in said meshing engagement with the worm, and said spring is a helical spring located between the shaft and the rim.

24. The device of claim 21, wherein the tubular mount is injection-molded plastic.

25. The device of claim 24, wherein the housing includes a first stop and a second stop unitarily molded therewith, and the gear includes a first stop and a second stop, wherein when the gear is in the first position, the first stops are in mutual abutment to preclude rotation in the second direction, and when the gear is in the second position, the second stops are in mutual abutment to preclude rotation in the first direction.

26. The device of claim 25, wherein the device further comprises an injection-molded closure plate, and the housing includes a hollow portion and the housing and plate have opposing walls shaped to abut a housing of the motor when the hollow portion and the plate are secured together, and the plate further includes protrusions which extend into the housing interior to abut sides of the motor housing to preclude movement therepast.

27. The device of claim 26, wherein the hollow portion includes an upstanding peripheral ridge unitarily molded therewith, and shaped to abut an inner surface of the plate, and the plate of the housing includes an upstanding peripheral ridge unitarily molded therewith and shaped to abut an inner surface of the housing, to protect against the egress of water into the interior of the housing, and wherein the ridges are located to provide a water flow path around the outer periphery thereof.

28. The device of claim 27, wherein the tubular mount of the housing has an open end and the gear is rotatably mounted therein by means of a shaft extending from the gear that is received in said open end, the gear including a rim spaced from the shaft, and the spring is located between the rim and the tubular mount of the housing.

29. The device of claim 28, wherein the housing plate includes an aperture in communication with the central aperture of the gear, to permit passage of the camshaft therethrough, and wherein the distal end of the camshaft includes at least one resilient finger received through the communicating apertures and having a surface in abutting contact with an opposing surface of the gear to preclude axial withdrawal of the camshaft from the gear aperture.

30. The device of claim 29, wherein said cam surface for engaging the latch is oriented to move the latch in a direction having a vectorial component non-parallel to the direction of rotation of the gear shaft as the gear rotates in said first direction.

31. The device of claim 26, further comprising electrically conductive contacts embedded into the housing as the housing is molded, in electrical contact with the motor, and extending to the exterior of the housing for connection to an electric power supply.

32. The device of claim 26, wherein the housing and the closure plate include a plurality of holes in communication with each other and located to permit simultaneous fastening of the housing and closure plate together and fastening of the device adjacent said latch with the cam in operable proximity thereto.

33. The device of claim 21, wherein the worm, the worm gear and the spring are located within the housing.

34. The device of claim 33, wherein the housing is injected-molded and includes a first stop and a second stop unitarily molded therewith, and the gear includes a first stop and a second stop, wherein when the gear is in the first position, the first stops are in mutual abutment to preclude rotation in the second direction, and when the gear is in the second position, the second stops are in mutual abutment to preclude rotation in the first direction.

35. The device of claim 34, wherein the device further comprises an injection-molded closure plate, and the housing includes a hollow portion and the housing and plate have opposing walls shaped to abut a housing of the motor when the hollow portion and the plate are secured together, and the plate further includes protrusions which extend into the housing interior to abut sides of the motor housing to preclude movement therepast.

36. The device of claim 35, wherein the housing plate includes an aperture in communication with the central aperture of the gear, to permit passage of the camshaft therethrough, and wherein the distal end of the camshaft includes at least one resilient finger received through the communicating apertures and having a surface in abutting contact with an opposing surface of the gear to preclude axial withdrawal of the camshaft from the gear aperture.

37. The device of claim 36, wherein the at least one resilient finger includes a tab extending out radially from the axis of the camshaft, and the tab provides the surface in abutting contact with the surface of the gear that faces away from the cam.

38. The device of claim 37, wherein the tab includes a chamfered surface to facilitate entry of the resilient finger into the aperture.

39. The device of claim 34, wherein the worm gear includes a catch for retaining a first end of the spring.

40. The device of claim 39, wherein one of the first and second stops formed in the housing is adapted to retain a second end of the spring.

41. A device for releasing a latch comprising:

a housing having a recessed region and a tubular mount extending from the center of the recessed region, the tubular mount having an open end;

an electric motor mounted in the housing;

a worm operatively coupled to the motor for driving rotation of the worm about an axis in a first rotational direction;

a worm gear, in meshing engagement with the worm and having a shaft and an outer rim spaced from the shaft by a gear wall, the shaft extending into the open end of the tubular mount so as to be rotatably mounted thereon and being mounted in the housing for rotation about an axis substantially orthogonal to the worm axis;

a camshaft mounted on the worm gear and having a rotation axis coincident with the gear axis, the camshaft having a distal end extending to the exterior of the housing;

a cam affixed at said distal end of the camshaft, having a surface for engaging the latch to move the latch from a closed position to a release position as the gear rotates in a first direction from a first position to a second position under control of the motor; and wherein the worm gear is biased against the rotation from the first position to the second position by a helical spring, located between the tubular mount and the rim on the worm gear, connected between the gear and the housing such that energy is transferred from the motor to the spring as the gear rotates from said first position to said second position under control of the motor and, when the motor is powered down, the energy stored in the spring causes the gear to rotate in a second direction, opposite to the first direction, from the second position to the first position.

* * * * *